US011053035B2

(12) United States Patent
D'Anglade

(10) Patent No.: US 11,053,035 B2
(45) Date of Patent: Jul. 6, 2021

(54) METHOD FOR HANDLING AND DRYING CARDBOARD TUBES

(71) Applicant: Abzac Canada Inc., Drummondville (CA)

(72) Inventor: Pierre-Michel D'Anglade, Montréal (CA)

(73) Assignee: Abzac Canada Inc., Drummondville (CA)

( * ) Notice: Subject to any disclaimer, the term of this patent is extended or adjusted under 35 U.S.C. 154(b) by 109 days.

(21) Appl. No.: 16/598,705

(22) Filed: Oct. 10, 2019

(65) Prior Publication Data

US 2020/0047931 A1 Feb. 13, 2020

Related U.S. Application Data

(63) Continuation of application No. PCT/CA2018/050438, filed on Apr. 10, 2018.

(60) Provisional application No. 62/483,511, filed on Apr. 10, 2017.

(51) Int. Cl.

| | |
|---|---|
| ***B65B 19/34*** | (2006.01) |
| ***B65B 11/02*** | (2006.01) |
| ***B65B 27/10*** | (2006.01) |
| ***B65B 5/06*** | (2006.01) |
| ***B65B 63/08*** | (2006.01) |

(52) U.S. Cl.

CPC ..... *B65B 19/34* (2013.01); *B65B 5/067* (2013.01); *B65B 11/02* (2013.01); *B65B 27/10* (2013.01); *B65B 63/08* (2013.01)

(58) Field of Classification Search

CPC ..... B65B 19/34; B65B 19/00; B65B 63/08; B65B 11/02; B65B 5/045; B65B 5/067; B65B 27/10; B65B 35/56; B31C 11/06

See application file for complete search history.

(56) References Cited

U.S. PATENT DOCUMENTS

| | | | | |
|---|---|---|---|---|
| 3,638,790 | A * | 2/1972 | Schmid | B65D 71/0096 206/446 |
| 4,098,862 | A * | 7/1978 | Markhorst | B31C 11/02 156/194 |
| 4,879,956 | A * | 11/1989 | Shuert | B65D 19/0018 108/53.3 |
| 7,200,979 | B2 * | 4/2007 | Hannen | B65B 11/585 53/377.5 |
| 2016/0288444 | A1 * | 10/2016 | D'Anglade | B31C 11/06 |
| 2019/0275699 | A1 * | 9/2019 | Okumura | B28B 3/269 |

FOREIGN PATENT DOCUMENTS

| | | | |
|---|---|---|---|
| GB | 1462626 | A | 1/1977 |
| JP | 2012066851 | A | 4/2012 |
| NL | 7602246 | A | 9/1977 |

OTHER PUBLICATIONS

Written opinion of the International searching authority, PCT/CA2018/050438, dated Apr. 10, 2018.

International Search Report, PCT/CA2018/050438, dated Apr. 10, 2018.

* cited by examiner

*Primary Examiner* — Thomas M Wittenschlaeger

(74) *Attorney, Agent, or Firm* — Price Heneveld LLP

(57) ABSTRACT

A method for handling and drying cardboard tubes is provided. The method involves using the skids for supporting cardboard tubes during the drying, wrapping and transport of the cardboard tubes, in order to reduce handling of the tubes while maintaining a low moisture level in the tubes.

10 Claims, 12 Drawing Sheets

METHOD FOR HANDLING AND DRYING CARDBOARD TUBES

CROSS REFERENCE TO RELATED APPLICATIONS

The present invention is a U.S. continuation application of international patent application No. PCT/CA2018/040538, which claims priority to U.S. provisional patent application No. 62/483,511, both of which are incorporated by reference herein in their entireties.

TECHNICAL FIELD

The present invention relates to the field of paper and cardboard tube manufacturing, and more particularly relates to a method for handling and drying manufactured paper and cardboard tubes meant for distribution from a supplier to a customer.

BACKGROUND

Many factors have put pressure on manufacturers and suppliers to reduce their costs in order to deliver products at competitive prices. This is unequivocally the case for paper and cardboard tube manufacturers.

The manufacturing of spiral or radial wound tubes requires helical or concentric winding of multiple strips of paper or cardboard. An adhesive is applied to bind the multiple strips of cardboard together in order to create wound tubes. The tubes are manufactured in various lengths and diameters, in addition to various thicknesses and material specifications. However, the solutions known in the art are not well adapted for shorter tubes, generally having a length of 80 cm or less.

Typically, at the end of the winding process, as shown in FIG. 1, the wound tubes are grouped in bundles using plastic strips. This configuration is generally unstable for shorter tubes and the adhesive binding tends to loosen under the weight of the tubes.

Following the winding process, a drying process generally takes place. In an industrial dryer, the shorter tubes may be placed vertically or horizontally. Alternatively, the shorter tubes are palletized and maintained with strips to hold the tubes together, and the pallets are stacked as shown in FIG. 2.

Alternatively, the shorter tubes may be placed on racks, like the one shown in FIG. 3. The racks are then placed in a dryer where the space within the dryer is fully utilized and subsequently the batch size within the dryer is maximized. When the tubes are dried in large metallic racks, the same racks can be used for transporting the tubes from the manufacturer to the customer.

However, the use of large metal racks is generally only possible when the customer has sufficient warehouse space and the distance between the manufacturer and the customer is relatively short, in order to minimize transportation costs, given the weight of the racks.

Furthermore, the use of racks occupies substantial amounts of valuable space both for the manufacturer and for the customer who keeps the large racks on-site until the tubes are depleted and the stocks are replenished by the manufacturer. The empty racks occupy the same amount of storage space as full racks. Adversely, the racks being tied up at the customer's site also restricts shipping capacity for the manufacturer as the racks needed are unavailable until returned by the initial customer. These drawbacks create bottlenecks in the supply chain and further incur additional costs. It is also noteworthy that the use of racks involves a capital investment as the racks must be customized and not all customers are equipped to handle these types of racks.

Another drawback of the methods known in the art, is that once the cardboard tubes are dry, if they are not protected from ambient air and sealed as soon as possible, they tend to reabsorb moisture. An increased moisture level due to vapor is likely to affect both the length, even if by a few millimeters, and the resistance of the cardboard tubes.

It is known that the moisture level in a wound tube and the tube's length are related, with an approximate increase of 0.12% of the length of the tube per percentage point of moisture content in the tube. It is therefore important that the moisture level in the sidewalls of cardboard tubes be uniform so that the respective lengths of the cardboard tubes do not vary from one tube to the other within the same batch. Normally, in a horizontal position, on racks for instance, the end of a shorter tube closest to the drying vents is often very dry, whereas, on its opposite end, it is only sufficiently dry. This results in a moisture variance of about 1.2% over the length of the tube. Since the length of a tube after the drying process is directly related to the tube's moisture content, a higher moisture content generally results in longer tubes. If the tubes of a batch are not dried uniformly, the length of each respective tube within the batch, will likely vary. This situation is undesirable since the tubes are often used in winding machines for the packaging of plastic films, and these winding machines have tight tolerances with regard to the length of the cardboard tubes used.

As described in US 2016/0288444, the Applicant has developed a method in which perforated boxes are used for drying horizontally oriented cardboard tubes and wherein the same perforated boxes are used for the shipment of the cardboard tubes. This method reduced handling since the tubes are kept in the same orientation from the moment they exit of the winding machine, to the drying process, to the pallet and finally to the delivery to the customer. Another advantage of this method is that the perforated boxes are collapsible, hence they occupy less storage space once they are collapsed. However, the bottom side of the boxes are not impervious to ambient air and allow moisture to infiltrate the tubes, even if the top and sides of the boxes are wrapped in plastic film. Consequently, the method described in US 2016/0288444 does not completely address the issue of moisture level in the wound tubes when transported to the customers' sites. In addition, it was found that after reusing the collapsible cardboard boxes, their structural integrity was affected, which in turn affected the structural integrity of the cardboard tubes transported therein.

Thus, known methods for drying, storing and transporting manufactured tubes lack the full set of attributes needed for obtaining uniformly dried tubes, minimizing the handling of said tubes, stabilizing pallets for both safe storage and transportation, avoiding damaged product and/or avoiding moisture reabsorption in order to increase productivity and satisfy the needs of the customer. Therefore, there exists a need in the art for a method for handling and drying manufactured paper and cardboard tubes from a supplier to a customer which alleviates at least some of the drawbacks of the prior art.

SUMMARY

One aspect of the present invention provides a method for handling and drying cardboard tubes to satisfy at least some of the above-mentioned needs and is thus an improvement over other methods know in the prior art.

More particularly, and according to an aspect of the invention, there is provided a method for handling and drying cardboard tubes comprising multiple steps.

According to the first step of the method, the cardboard tubes are collected in a horizontal orientation at the exit of a conveyor, the cardboard tubes being wet from a previous winding and gluing process, and the sidewalls having a given moisture level.

Then, the second step of the method consists in stacking the cardboard tubes vertically on a skid to form a stack, the stack of cardboard tubes having bottom, top and lateral sides. The top face of the skid supports the stack and the bottom face of the skid, faces the ground. The skid is traversed by channels or openings extending from the top to the bottom face, allowing air to circulate therethrough during the drying step.

According to the third step of the method, the skid supporting the stack is placed in a dryer with the cardboard tubes, the air flow circulating through the skid and cardboard tubes. The stack of tubes is dried, by circulating air in the dryer for a predetermined period of time, at a predetermined temperature, which may the ambient or higher temperatures. Drying the cardboard allows to lower the moisture level of the cardboard tubes.

According to another step of the method, at least some of the sides of the stack are sealed at the exit of the dryer, by wrapping the stack with a plastic film while keeping the stack on the same skid used in the fourth step. According to one configuration, a plastic bag is used to wrap the skid with the cardboard tubes standing thereon.

In some embodiments, the periphery of the stack is made of cardboard tubes grouped and attached together in a vertical position to form bundles. The bundles are holding loose cardboard tubes in the middle of the stack. In other configurations, the entirety of the stack is made of bundles, i.e. of cardboard tubes attached by strips or similar means. It is possible not to attach the cardboard tubes at all.

In some embodiments, the skid used to stack cardboard tubes vertically is nestable with other similar skids.

In other embodiments of the invention, during the fifth step of the method, sealing of the bottom side of the stack is completed by nesting the skid, referred as a first skid, on a second skid. The second skid is different from the first skid in that it has a top face that is continuous and smooth, without channels extending therethrough. Once the first skid is nested in the second skid, the second skid forms a barrier against humidity, and prevents the dried cardboard tubes from absorbing ambient humidity through the bottom side of the stack.

In another embodiment of the invention, during the another step of the method, sealing the stack on the first skid comprises the further step of placing a plastic film on the top face of a second skid, similar to the first skid, and nesting the first skid into the second skid, thereby trapping a portion of the plastic film between the first and second skid. Once the first and second skid are nested one into another, the plastic film is used to wrap the first skid supporting the stack, as well as the lateral and top sides of the stack to prevent the dried cardboard tubes from absorbing ambient humidity from the bottom side, lateral sides and top side of the stack. In some embodiments of the method, a plastic bag can be used, so as to prevent or limit moisture reabsorption by the cardboard tubes, the bag completely surrounding the cardboard tubes, or surrounding the cardboard tubes and the top skid.

In another embodiment, after shipment of the cardboard tubes to a remote location, the method further includes a step of reusing the nestable skids for handling and drying additional cardboard tubes, and also possibly reusing the plastic bags.

The objects, advantages and features of the present invention will become more apparent upon reading the following non-restrictive description of preferred embodiments thereof, given for the purpose of exemplification only, with reference to the accompanying drawings.

DETAILED DESCRIPTION

Figure 1:
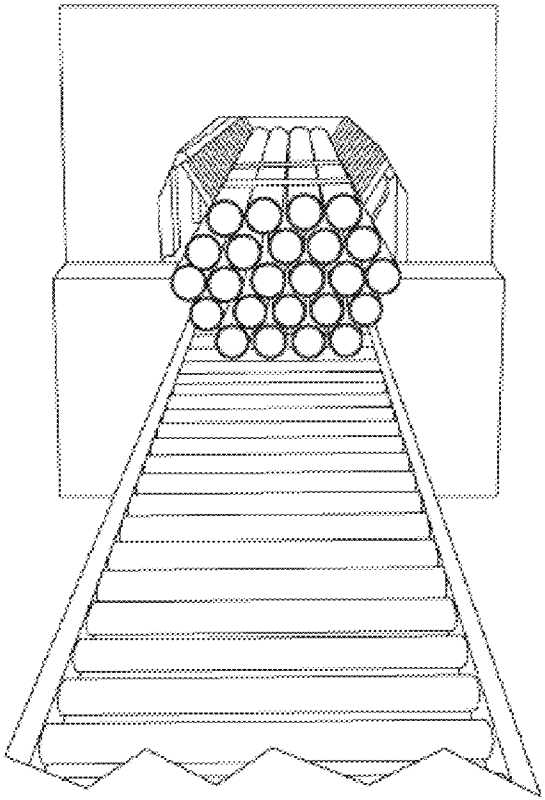
FIG. 1 (PRIOR ART)
FIG. 1 is a perspective view of tubes at the conclusion of the winding process, where the tubes are grouped in bundles on a conveyor, in accordance with the prior art.
Figure 2:
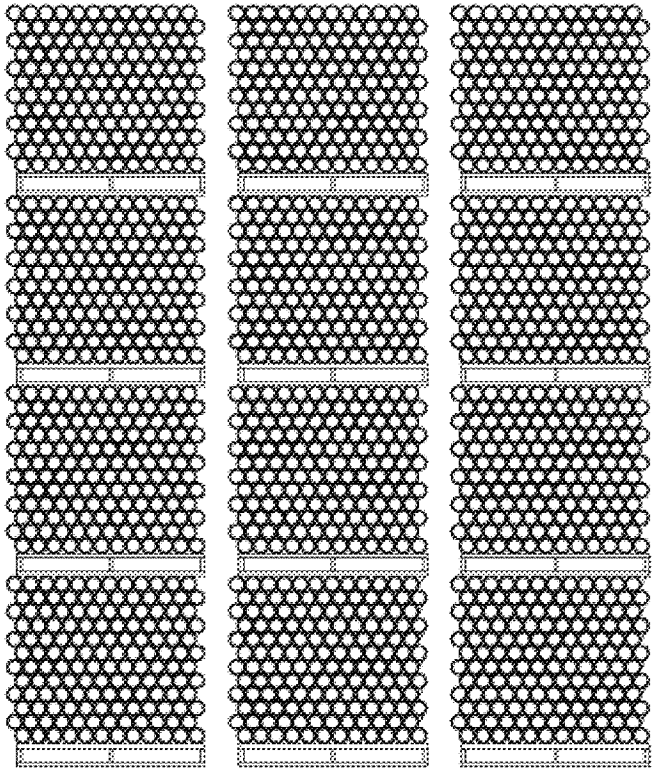
FIG. 2 (PRIOR ART)
FIG. 2 is a front view of tubes on stacked pallets with plastic strips to hold the tubes together, in accordance with the prior art.
Figure 3:
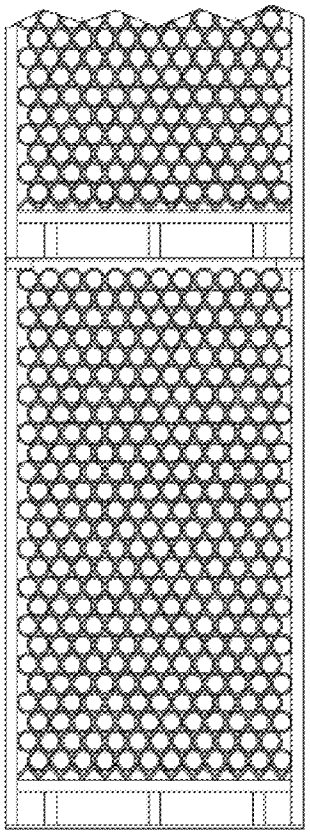
FIG. 3 (PRIOR ART)
FIG. 3 is a front view of tubes stored on large metallic racks.
Figure 4:
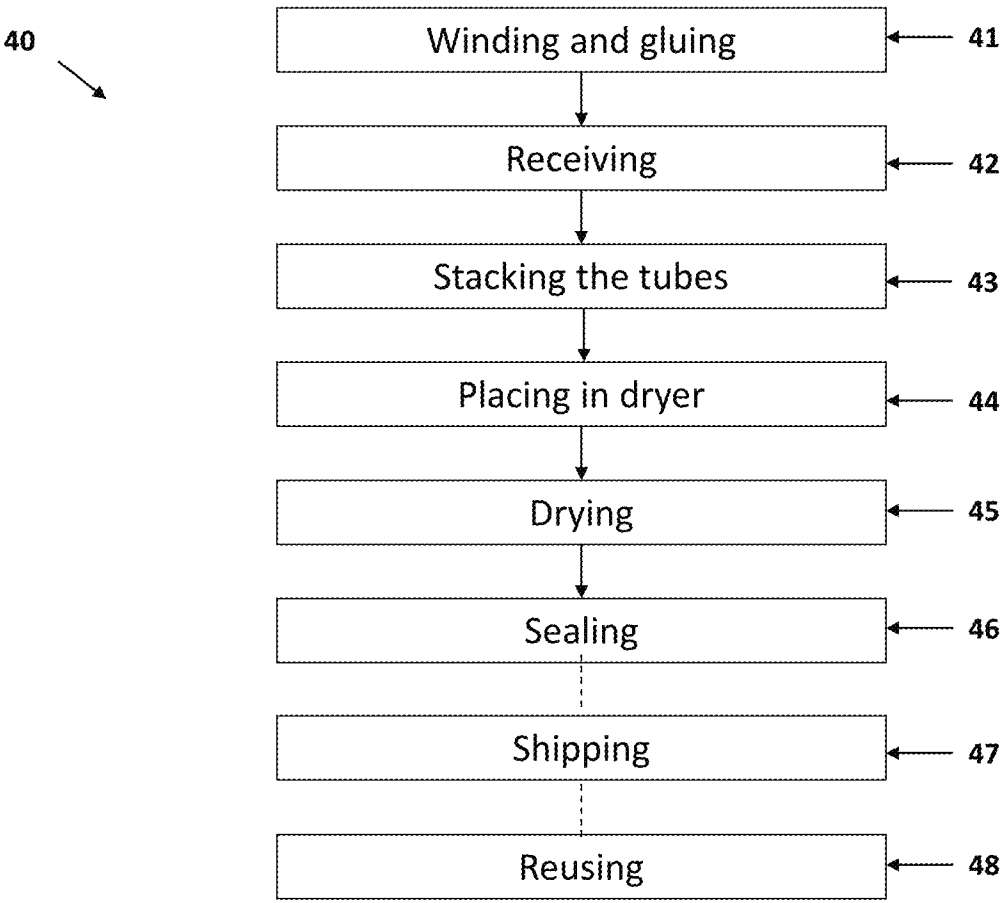
FIG. 4 is a flow chart of a method for handling and drying cardboard tubes in accordance with an embodiment of the present invention.

In the following description, the same numerical references refer to similar elements. Furthermore, for the sake of simplicity and clarity, namely so as to not unduly burden the figures with several reference numbers, not all figures contain references to all the components and features of the present invention and references to some components and features may be found in only one figure, and components and features of the present invention illustrated in other figures can be easily inferred therefrom. The embodiments, geometrical configurations, materials mentioned and/or dimensions shown in the figures are preferred, for exemplification purposes only.

Moreover, in the context of the present invention, the expression "tube" is intended to refer to tubes crafted in an industrial operation. The tubes refer to hollow cylinders that may be further used for containing materials or as an axle for supporting materials. In the case of an axle, the tube is often referred to as a mandrel. The tubes are generally manufactured using spiral or radial technologies, as known in the art, for helically or concentrically winding multiple strips of paper or cardboard, by applying an adhesive to bind the multiple strips together during the manufacturing process.

The expression "cardboard" is intended to refer to a material made of pressed paper pulp or pasted sheets made from paper pulp and used in the manufacturing of wound tubes.

Furthermore, the expression "drying" is intended to refer to any process by which moisture is removed or extracted. This process generally takes place in an industrial dryer with fans circulating or pushing air in and around the cardboard tubes. Air within the dryer is circulated with sufficient turbulence to enable proper drying of the tubes.

Furthermore, the expressions "wrap" and "wrapping" are used in the sense of covering, enclosing or enveloping.

Furthermore, the expressions "seal" and "sealing" are used in the sense of making an area impervious from its surroundings.

Furthermore, the expression "stack" and "stacking" are intended to refer to placing material on skids for transportation, drying or storage.

Furthermore, the expression "vertical position" is intended to refer to the orientation of the cardboard tubes where the two circular surfaces of the cylinders constituting the tubes are facing the ground and the ceiling.

Furthermore, the expressions "nestable" and "nesting" are intended to refer to the action of fitting objects one within another.

Furthermore, the order of the steps of the method described herein should not be taken as to limit the scope of the invention, the sequence of the steps may vary in a number of ways without affecting the scope or working of the invention, as can also be understood.

It is to be understood that certain descriptions of the present invention have been simplified to illustrate only those elements and limitations that are relevant to a clear understanding of the present invention, while eliminating, for purposes of clarity, other elements. Those of ordinary skill in the art, upon considering the present description of the invention, will recognize that other elements and/or limitations may be desirable in order to implement the present invention. However, because such other elements and/or limitations may be readily ascertained by one of ordinary skill upon considering the present description of the invention, and are not necessary for a complete understanding of the present invention, a discussion of such elements and limitations is not provided herein. As such, it is to be understood that the description set forth herein is merely exemplary of the present invention and is not intended to limit the scope of protection.

Broadly described, the handling and drying method, according to the present invention, as shown in the accompanying drawings, is an improved method for handling and drying cardboard tubes in order to reduce manufacturing costs while improving the quality of the product.

According to an aspect of the invention, there is provided a method for handling and drying cardboard tubes.

Referring to FIGS. 4 to 12, the method 40 begins with step 42, which consists of receiving the cardboard tubes 50 in a horizontal orientation at the exit of a conveyor. The cardboard tubes 50 have respective sidewalls which are wet from the previous winding and gluing process, identified in step 41, and the sidewalls have a given moisture level.

Figure 6:
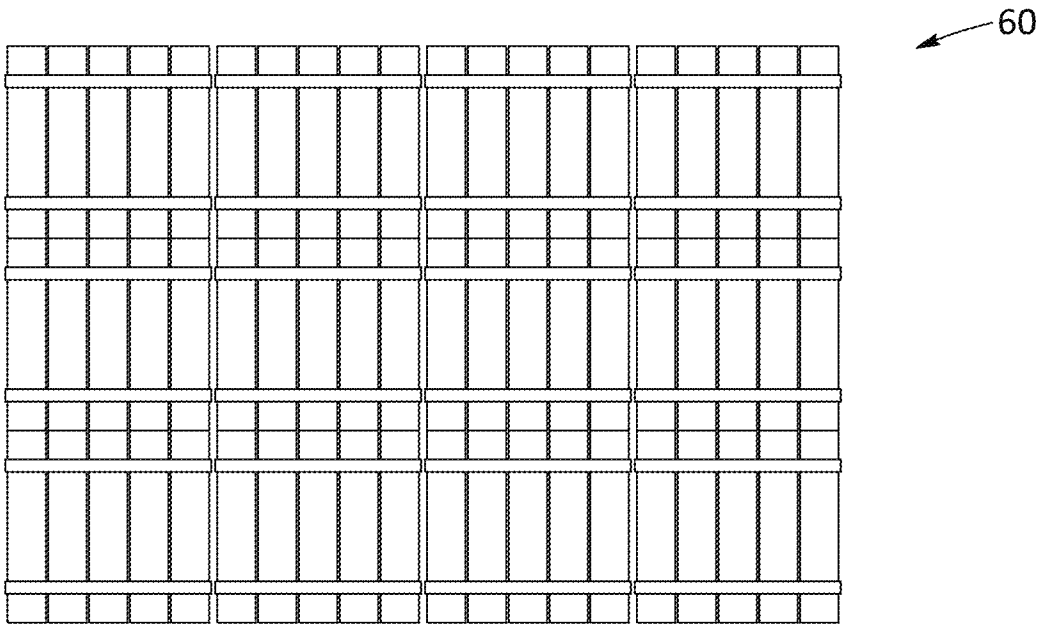
FIG. 6 is a front view of vertically oriented bundles grouped together to form a stack.
Figure 7:
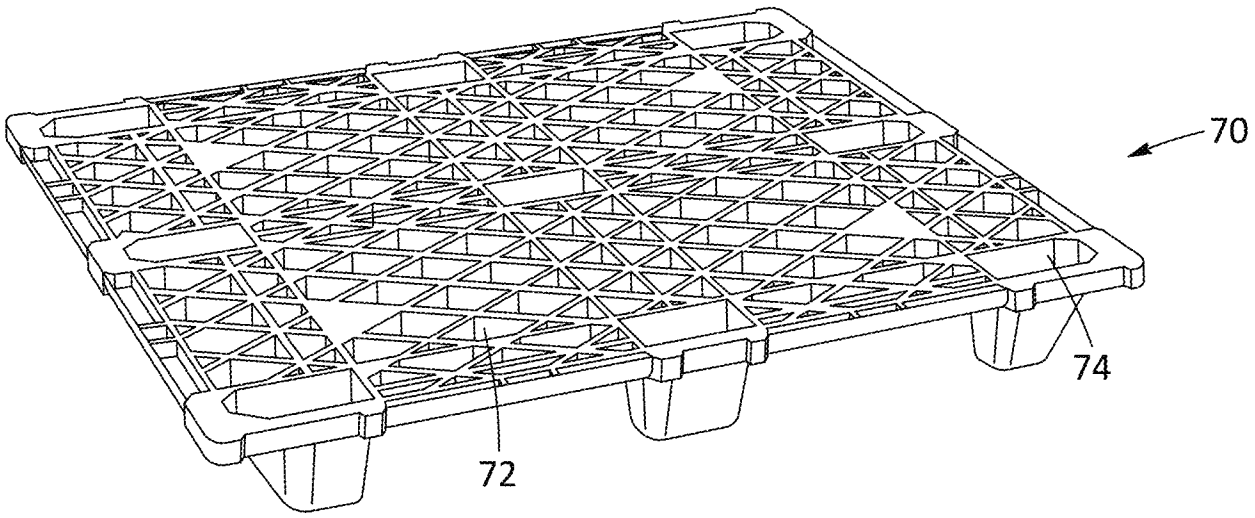
FIG. 7 is a top perspective view of a skid traversed by channels.
Figure 8:
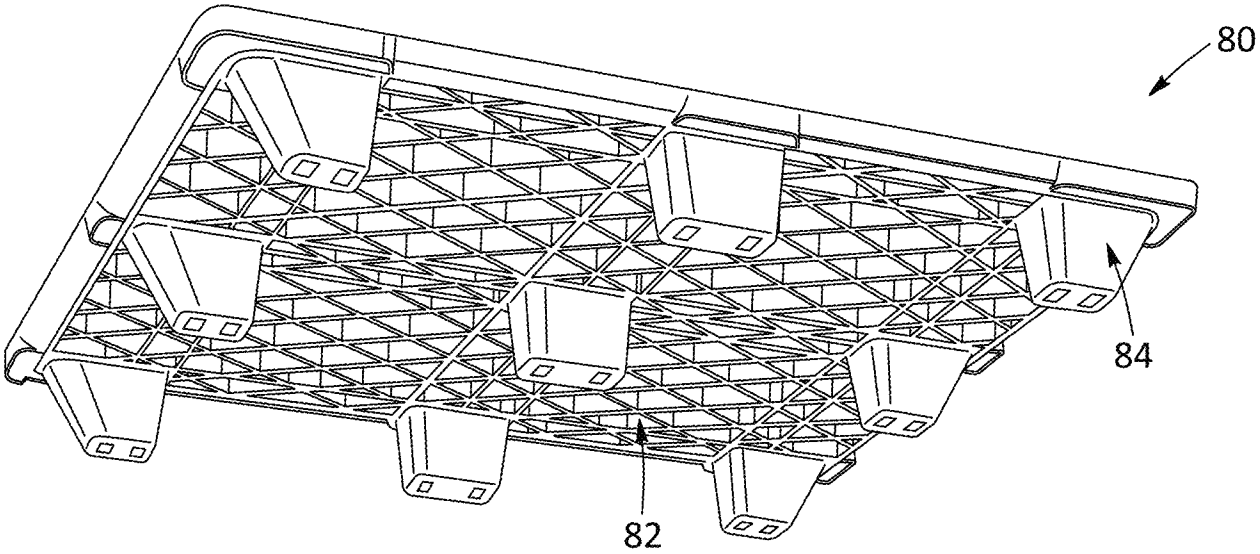
FIG. 8 is a bottom perspective view of a skid traversed by channels.

The next step 43 of the method 40, consists in stacking the cardboard tubes 50 on a skid 70 traversed by channels or openings 72 to form a stack 60. Referring to FIG. 6, the stack 60 preferably covers the entire supporting top face of the skid 70 and layers of cardboard tubes 50 are stacked gradually until they reach an optimal height for shipment. Now referring to FIG. 7, the skid 70 can be made of plastic or any other material suited for the transportation and drying step of the method 45, such as wood or metal. Furthermore, the channels 72 traversing the skid 70 may be distributed uniformly to ensure uniform drying of the cardboard tubes 50. Optionally, the surface of the skid 74 can take the form of a grid. Also, the depressions on the top face of the skid 74, which extend into protuberances on the bottom face of the skid 84, making the skids nestable into one another, are preferably distributed uniformly on the perimeter and the center of the skid. Referring to FIG. 8, a total of nine protuberances are aligned on three separate rows. The number of protuberances can vary as long as two skids can be nested effectively one into another. Although in the present embodiment, the depressions 74 extending into protuberances 84 are rectangular in shape, other shapes are possible as long as two skids can be nested effectively into one another. For example, the depressions 74 extending into protuberances 84 can take various shapes such as hemispheres, cubes or cylinders.

Figure 5:
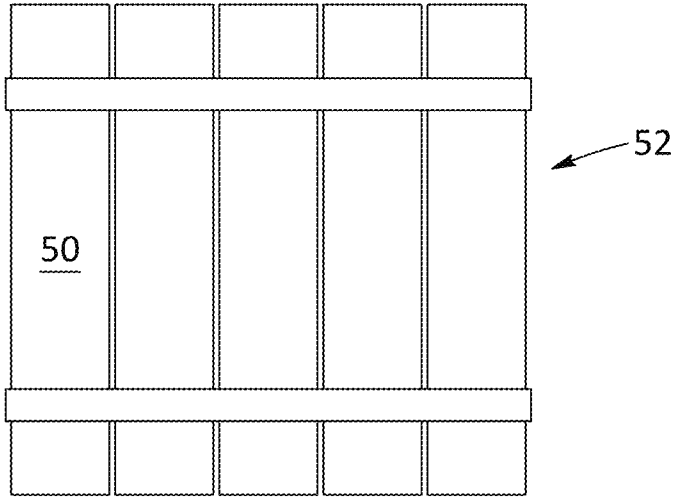
FIG. 5 is a front view of vertically oriented tubes grouped to form a bundle.

According to a first option of the stacking step 43, the periphery of the stack 60 is made of cardboard tubes 50 grouped and attached together in a vertical position to form bundles 52. The bundles 52 placed on the periphery of the stack are holding loose cardboard tubes in the middle of the stack 60. Referring to FIG. 5, the cardboard tubes 50 are held together as bundles 52 with plastic strips. Optionally, the cardboard tubes 50 can also be held together as bundles 52 with rope or plastic film. The number of cardboard tubes per bundle can vary, as long as the bundles remain stable.

According to a second option of the stack step 43, the entirety of the stack 60 is made of bundles 52. It is also possible to simply place the cardboard tubes on top of the skid, without attaching them, although this option is less practical.

The next step 44 of the method 40, consists in placing the stack 60 and the skid 70 supporting the stack 60, into an air dryer and drying the cardboard tubes 50 with the air flow 90 of the dryer.

Figure 9:
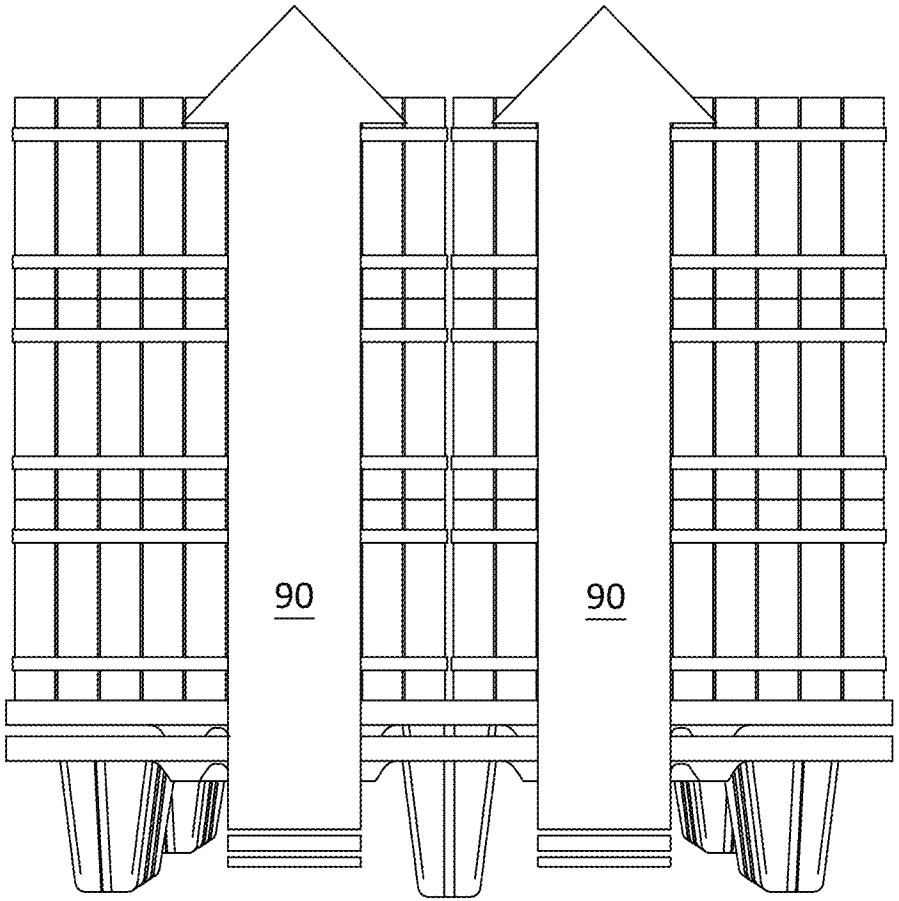
FIG. 9 is a front view of a stack placed on a skid in a dryer with the cardboard tubes aligned with an air flow circulating through the channels of skid and the cardboard tubes.
Figure 10:
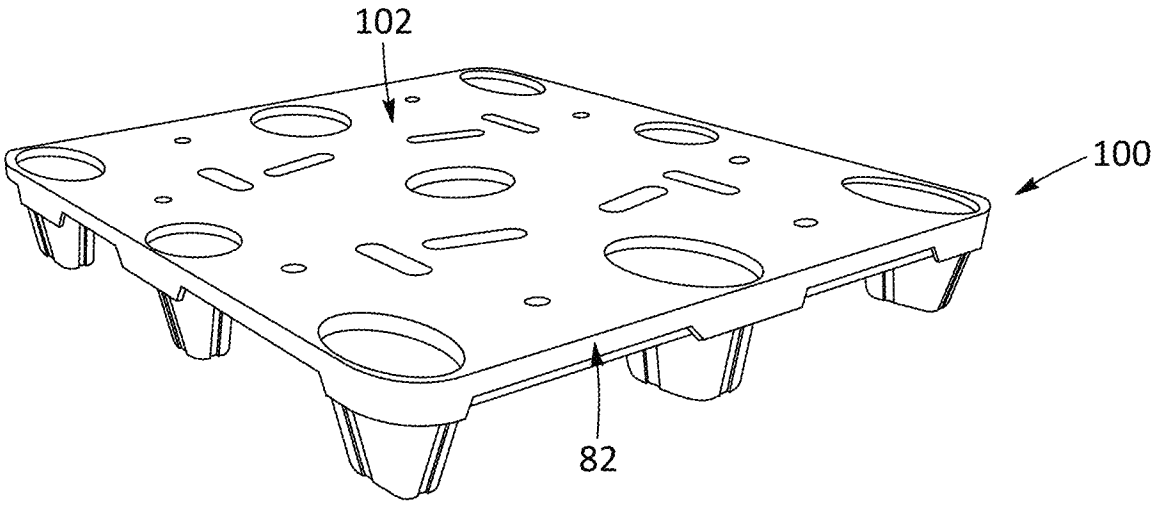
FIG. 10 is a perspective view of the top face of a second skid having a mostly continuous and smooth top face.

Once the stack and the skid supporting the stack are placed correctly into the dryer, step 45 consists of drying the cardboard tubes 50 by circulating air in the dryer through the channels 72 of the skid 70 and cardboard tubes 50 for a predetermined period of time, and thus lowering the moisture level of the cardboard tubes 50, as shown in FIG. 9. Preferably, the air flow inside the dryer 30 is heated to accelerate drying 510 the cardboard tubes 12.

After exiting the dryer, step 46 consists in sealing at least some of the sides of the stack. In one possible embodiment, the bottom, top and lateral sides of the stack 60 resting on the skid 70 are wrapped 60 with a plastic film while keeping the stack 60 on the same skid 70 used for the drying step 46. In some embodiments, the stack can be wrapped with a bag, a stretch film, a shrink film or a polycoated board. Alternately, a plastic bag can be used to wrap the stack, by either wrapping all sides (top, bottom and lateral sides of the stack), or preferably by simply leaving the stack atop of the skid, and wrapping the stack and the skid completely with the plastic bag, the opening of the bag being closed near the top side of the stack, and the bottom of the bag receiving the skid with openings and/or channels.

Figure 11:
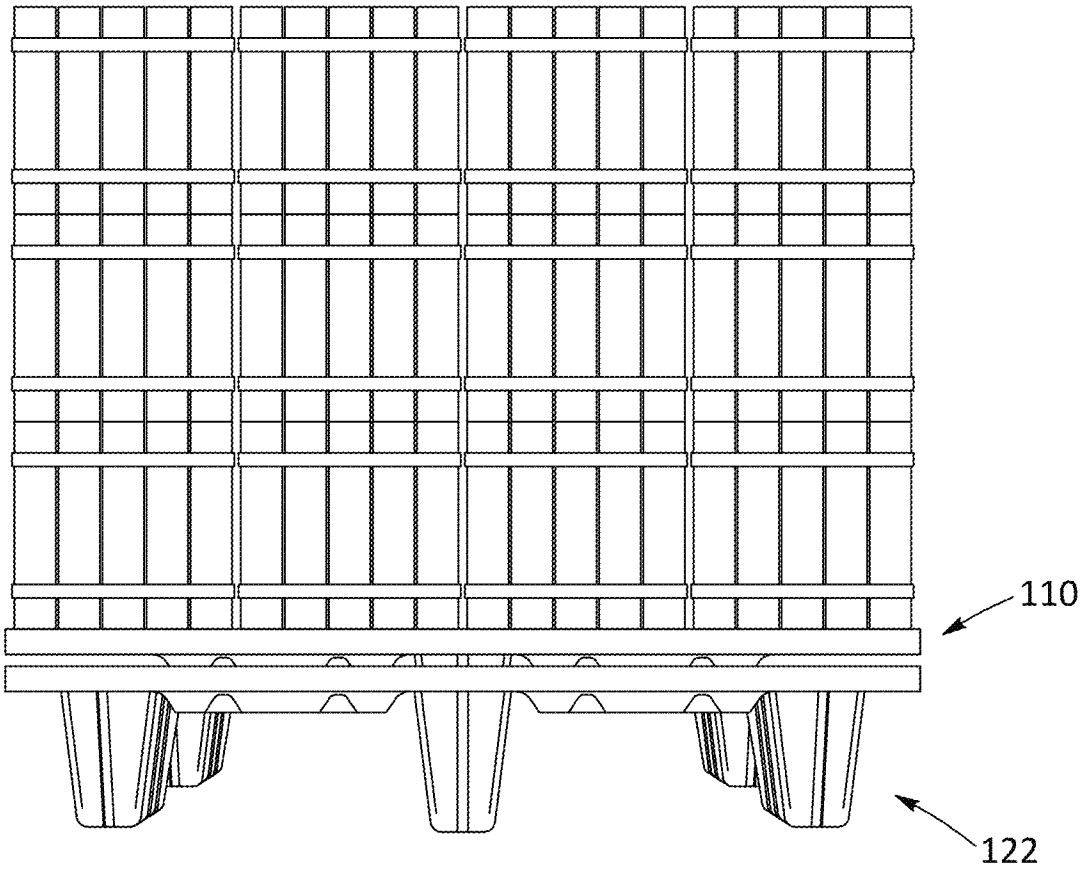
FIG. 11 is a front view of a stack placed on a skid nested in a second skid having a continuous and smooth top face.

According to a first option of the sealing step 46 and referring to FIG. 11, sealing of the bottom side of the stack 60 is carried out by nesting the skid 110 on a second skid 112, the second skid 100 having a top face that is continuous and smooth 102, without channels 72 extending therethrough. Advantageously, the second skid 112 forms a barrier against humidity, and prevents the dried cardboard tubes 50 from absorbing ambient humidity from the bottom side of the stack 60.

Figure 12B:
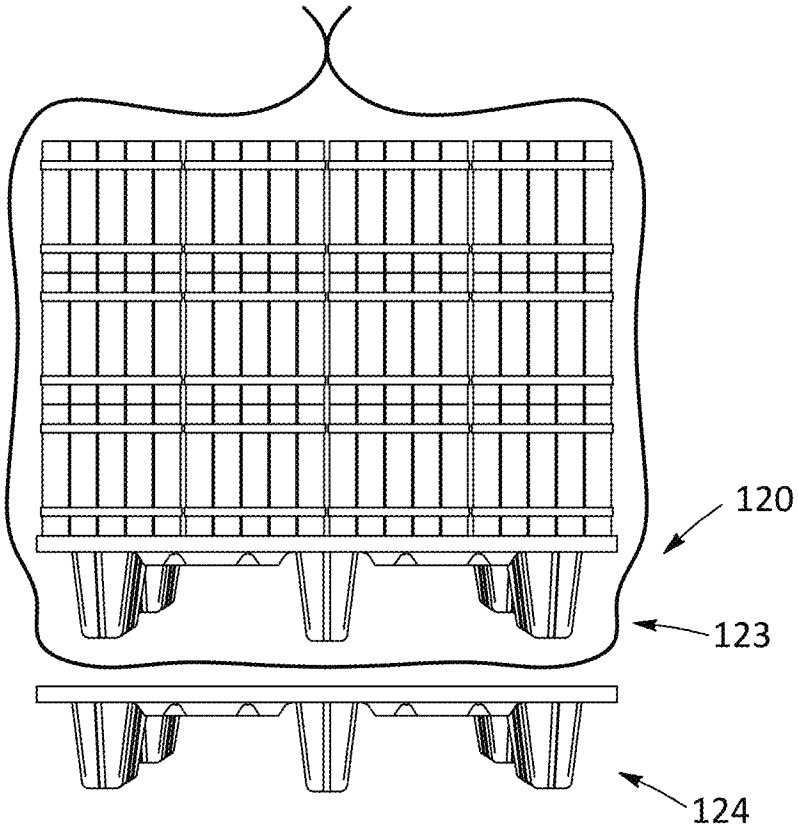
FIGS. 12A and 12B include front views of a stack placed on a skid nested in a similar second skid having a plastic film placed on its top face.
Figure 12A:
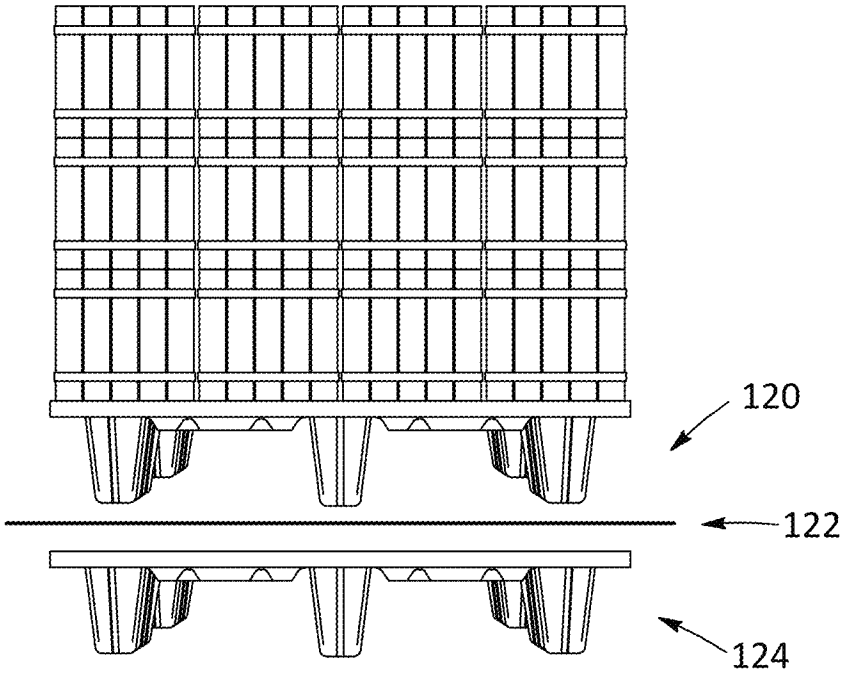

According to a second option of the same step 46, and referring to FIG. 12A, the sealing of the stack is carried out by placing a plastic film 122 on the top face 70 of a second skid 124, similar to the first skid 120 supporting the stack 60, and nesting the first skid 120 into the second skid 124, thereby trapping a portion of the plastic film 122 between the first and second skids (120,124), the plastic film being used to wrap the first skid supporting the stack, as well as the lateral and top sides of the stack. Advantageously, this prevents the dried cardboard tubes from absorbing ambient humidity from the bottom, lateral and top sides of the stack. As mentioned previously, a plastic bag 123 can be used at this step, as shown in FIG. 12B.

According to another aspect of the invention, the method comprises the further steps of shipping 47 the cardboard tubes to a remote location and reusing 48 the nestable skids for handling and drying additional cardboard tubes. The plastic film and/or bag can also be reused.

Advantageously, the use of nestable skids according to embodiments of the invention, allows for the preservation of the uniformly dried tubes by preventing the dried cardboard tubes from absorbing ambient humidity through the bottom side of the stack, in addition to reducing the amount of product handling. Other benefits of the method, according to embodiments of the invention, relate to a more stable packaging, which better protects the tubes during storage and transportation. Furthermore, supplying the tubes stacked on skids to the customer eliminates the need for racks or perforated boxes, and greatly simplifies the current procedures for both the supplier and the customer. The skids also weigh less than the heavy metallic racks which can provide reduced transportation costs and a smaller ecological footprint. Furthermore, after the customer has finished collecting cardboard tubes on the skids, the skids can be nested into one another and thereby occupy less storage space.

Advantageously, the method according to various embodiments of the invention, allows for uniform drying, and supplying of tubes with reduced handling, raw material, packaging and inventory costs on the manufacturer's end. In turn, this allows the manufacturer to increase productivity and supply tubes at competitive prices.

Of course, numerous modifications could be made to the above-described embodiments without departing from the scope of the invention, as apparent to a person skilled in the art.

The invention claimed is:

1. A method of handling and drying cardboard tubes, comprising:

receiving the cardboard tubes in a horizontal orientation at the exit of a conveyor, the cardboard tubes being wet from a previous winding and gluing process, and having a given moisture level;

stacking the cardboard tubes vertically on a skid to form a stack, said skid having a top face supporting the stack and bottom face facing the ground, the skid being traversed by channels or openings extending from the top to the bottom face allowing air to circulate therethrough, the stack having bottom, top and lateral sides;

placing the skid supporting the stack into a dryer, the air flow circulating through the skid and cardboard tubes, and drying the stack by circulating air in the dryer for a predetermined period of time, lowering the moisture level of the cardboard tubes; and sealing at least the bottom, top and lateral sides of the stack at the exit of the dryer by wrapping the stack with a plastic film while keeping the stack on the same skid used for drying the stack.

2. The method as of claim 1, wherein the skid is nestable with other similar skids, wherein said skid is a first skid, the method further comprising nesting the first skid into a second skid, the plastic film being used to wrap at least the lateral and top sides of the stack, thereby preventing the dried cardboard tubes from absorbing ambient humidity from the bottom, lateral and top side of the stack.

3. The method as of claim 2, further comprising placing the plastic on the top face of a second skid, before nesting the first skid into the second skid, thereby trapping a portion of the plastic film between the first and second skids, the plastic film being used to wrap the first skid supporting the stack, as well the stack.

4. The method as of claim 3, wherein the plastic film comprises a bag, the bag having a bottom end and an top end with an opening, the bottom end receiving the skid and the cardboard tubes standing vertically thereon, the top end being closed over the top side of the stack, the skid and cardboard tubes being sealed within the plastic bag.

5. The method as of claim 3, further comprising reusing the nestable skids for handling and drying additional cardboard tubes performed after shipment of the cardboard tubes to a remote location.

6. The method as of claim 2, wherein the second skid has a top face that is continuous and smooth, without channels extending therethrough, the second skid forming a barrier against humidity, and preventing the dried cardboard tubes from absorbing ambient humidity from the bottom side of the stack, the plastic film wrapping the lateral and top sides of the stack preventing ambient humidity from being absorbed by the lateral and top side of the stack.

7. The method as of claim 2, wherein the air flow inside the dryer is heated when sealing the at least the bottom, the top and the lateral sides of the stack.

8. The method as of claim 2, further comprising reusing the nestable skids for handling and drying additional cardboard tubes performed after shipment of the cardboard tubes to a remote location.

9. The method as of claim 2, wherein when stacking the cardboard tubes, the periphery of the stack is made of cardboard tubes grouped and attached together in a vertical position to form bundles, said bundles holding loose cardboard tubes in the middle of the stack.

10. The method as of claim 2, wherein the entirety of the stack is made of bundles.

* * * * *